United States Patent [19]

Cour

[11] Patent Number: 4,935,967

[45] Date of Patent: Jun. 26, 1990

[54] AUTOMATED TOILET SEAT COVER APPARATUS

[76] Inventor: Regina A. Cour, 5105 Kings Grove Ct., Burke, Va. 22015

[21] Appl. No.: 310,878

[22] Filed: Feb. 16, 1989

[51] Int. Cl.[5] ..... A47K 13/22

[52] U.S. Cl. ..... 4/247; 4/242

[58] Field of Search ..... 4/242, 243, 244, 245, 4/246, 247

[56] References Cited

U.S. PATENT DOCUMENTS

| | | | |
|---|---|---|---|
| 2,491,187 | 12/1949 | Knoetzsch | 4/247 |
| 3,271,792 | 9/1966 | Tromp | 4/247 |
| 3,961,386 | 6/1976 | Beno | 4/247 |
| 4,213,212 | 7/1980 | Hefty et al. | 4/247 |
| 4,297,750 | 11/1981 | Lutz | 4/247 |
| 4,662,009 | 5/1987 | Hefty | 4/247 |
| 4,760,613 | 8/1988 | Bobak | 4/247 |
| 4,766,618 | 8/1988 | Boker | 4/247 |
| 4,847,922 | 7/1989 | Ive-Tzuny et al. | 4/247 |

FOREIGN PATENT DOCUMENTS

| | | | |
|---|---|---|---|
| 1220902 | 4/1987 | Canada | 4/247 |
| 3331740 | 3/1984 | Fed. Rep. of Germany | 4/247 |

*Primary Examiner*—Henry J. Recla
*Assistant Examiner*—Edward C. Donovan
*Attorney, Agent, or Firm*—Leon Gilden

[57] ABSTRACT

An automated toilet seat cover is provided wherein a plurality of spaced parallel rolls are rotatably mounted within the housing positioned between rearwardmost ends of a toilet seat. The rolls are provided with rearwardly extending axles with gears secured thereon for cooperation with a medially positioned selectively actuatable motor for simultaneously dispensing and reeling in a tubular seat cover for overlying securement of the toilet seat. The motor is provided with a rearwardly extending axle positioned exteriorly of the housing with a manually rotatable wheel for manual actuation of the plurality of rolls.

6 Claims, 1 Drawing Sheet

AUTOMATED TOILET SEAT COVER APPARATUS

BACKGROUND OF THE INVENTION

1. Field of the Invention

The field of invention relates to toilet seat covers, and more particularly pertains to a new and improved automated toilet seat cover wherein the same is provided with a housing centrally positioned between opposed ends of a toilet seat selectively actuatable to present successive covering to the associated toilet seat.

2. Description of the Prior Art

The use of various automated toilet seat covers for effecting sanitary usage of the associated toilet seat is known in the prior art Heretofore the apparatus utilized in the prior art has been of a relatively cumbersome and expansive organization. Examples of prior art automated toilet seat covers may be found in examples such as U.S. Pat. No. 4,662,009 to Hefty wherein a detection system to check to see that a length of hose shaped foil is dispensed about an associated toilet seat in one seat length increments. The Hefty patent utilizes a plurality of spaced motors positioned in general alignment relative to one another to dispense and retract the foil associated with the toilet seat.

U.S. Pat. No. 4,297,750 to Lutz sets forth a housing including a roll of perforated toilet seat covers for positioning over a forwardly oriented toilet seat.

U.S. Pat. No. 8,271,792 to Tromp sets forth a toilet seat covering arrangement wherein a plurality of seat cushions including webs of paper mechanically drawn over the associated toilet seat driven by the swinging movement of the seat. The Tromp patent is typical of the prior art and the associated awkward use of spaced rolls for dispensing seat covering means.

U.S. Pat. No. 2,491,187 to Knoetzsch sets forth a toilet seat protector arrangement wherein pivotment of levering arrangements associated with the toilet seat effects dispensing of covering material to an associated toilet seat and as in the previously noted Tromp patent, is of a cumbersome and awkward arrangement in association with a toilet seat.

U.S. Pat. No. 3,961,386 to Beno sets forth an apparatus for positioning an endless sheet overlying a toilet seat including a plurality of housings positioned exteriorly of opposed sides of the associated commode to present a new toilet seat cover to an associated toilet seat.

As such, it may be appreciated that there is a continuing need for a new and improved automated toilet seat cover apparatus which addresses both the problems of compactness of organization and effectiveness in operation, and in this respect, the present invention substantially fulfills this need.

SUMMARY OF THE INVENTION

In view of the foregoing disadvantages inherent in the known types of automated toilet seat cover apparatus now present in the prior art, the present invention provides an automated toilet seat cover apparatus wherein the same is compactly efficiently positioned within a modular housing between opposed terminal ends of an associated toilet seat. As such, the general purpose of the present invention, which will be described subsequently in greater detail, is to provide a new and improved automated toilet seat cover apparatus which has all the advantages of the prior art automated toilet seat cover apparatus and none of the disadvantages.

To attain this, the present invention comprises an automated toilet seat cover apparatus wherein the same includes a plurality of spaced parallel rolls positioned within a modular housing with an associated drive motor therebetween. An actuating gear on the drive motor cooperates with driven gears on the spaced rolls to simultaneously dispense and retract associated covering material. An axially extending wheel extends exteriorly and in axial alignment with the motorized gear for manual actuation of the apparatus. The toilet seat is provided with a plurality of hinges secured to "U" shaped brackets extending from forward surfaces proximate the terminal ends of the toilet seat rearwardly in axial alignment with one another and a hinge mounting the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved automated toilet seat cover apparatus which has all the advantages of the prior art automated toilet seat cover apparatus and none of the disadvantages.

It is another object of the present invention to provide a new and improved automated toilet seat cover apparatus which may be easily and efficiently manufactured and marketed.

It is a further object of the present invention to provide a new and improved automated toilet seat cover apparatus which is of a durable and reliable construction.

An even further object of the present invention is to provide a new and improved automated toilet seat cover apparatus which is susceptible of a low cost of manufacture with regard to both materials and labor, and which accordingly is then susceptible of low prices of sale to the consuming public, thereby making such automated toilet seat cover apparatus economically available to the buying public.

Still yet another object of the present invention is to provide a new and improved automated toilet seat cover apparatus which provides in the apparatuses and methods of the prior art some of the advantages thereof, while simultaneously overcoming some of the disadvantages normally associated therewith.

Still another object of the present invention is to provide a new and improved automated toilet seat cover apparatus wherein the same is compactly oriented between spaced terminal ends of an associated toilet seat to dispense and retract covering material about the toilet seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
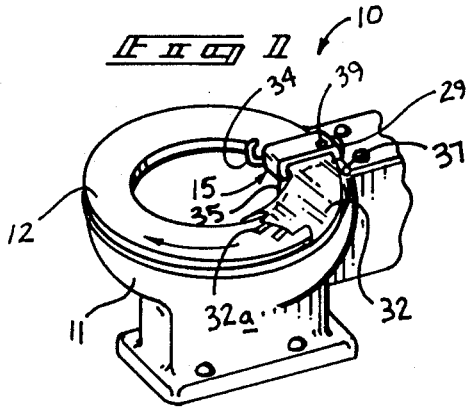
FIG. 1 is an isometric illustration of the instant invention.
Figure 2:
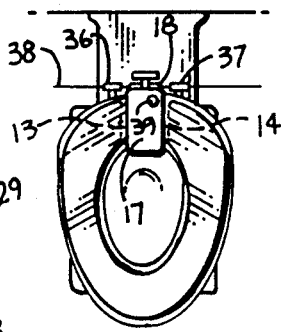
FIG. 2 is a top orthographic view of the instant invention.
Figure 6:
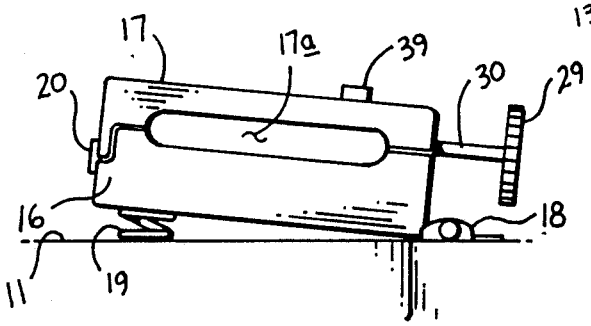
FIG. 6 is an orthographic side view taken in elevation of the housing of the instant invention.
Figure 3:
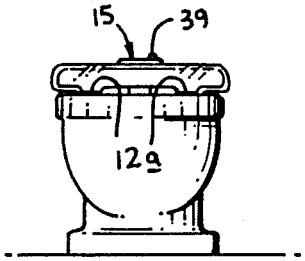
FIG. 3 is a frontal orthographic view taken in elevation of the instant invention.
Figure 4:
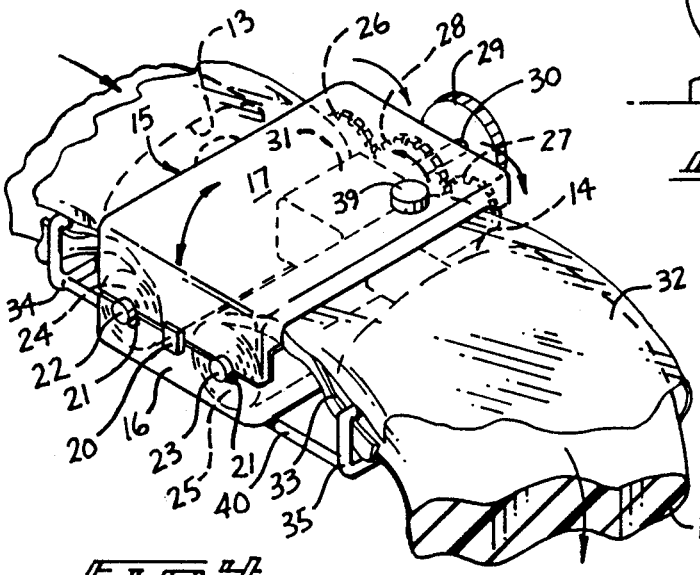
FIG. 4 is an isometric illustration, somewhat expanded, of the modular housing positioned between opposed terminal ends of an associated toilet seat lid.
Figure 5:
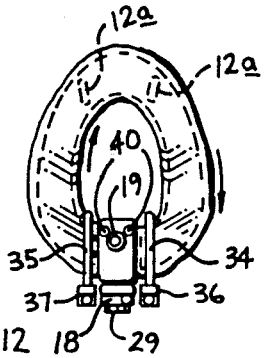
FIG. 5 is an orthographic bottom plan view of the instant invention.

With reference now to the drawings, and in particular to FIGS. 1 to 6 thereof, a new and improved automated toilet seat cover apparatus embodying the principles and concepts of the present invention and generally designated by the reference numeral 10 will be described.

More specifically, it will be noted that the automated toilet seat cover apparatus 10 essentially comprises a toilet seat 12 in combination with a commode 11. The toilet seat 12 is formed with spaced first and second terminal ends positioned rearwardly about the central opening of the commode with a housing 15 fixedly positioned therebetween.

The housing 15 is formed with a base 16 defining a compartment therewithin with an overlying pivotally mounted lid 17 with a first hinge 18 pivotally mounting a rearward edge of the base 16 to a top surface of the commode 11. A spring 19 is positioned between the base 16 and the top surface of the commode 11 to normally bias the housing 15 and associated toilet seat 12 upwardly at an angle relative to the top surface of the commode 11. A latch 20 normally secures the lid 17 relative to the base 16 and enables selective access to the interior compartment defined interiorly of the housing 15 to enable replenishment of the tubing utilized by the interiorly positioned retraction and dispensing rolls 24 and 25 respectively. The base 16 of the housing 15 is formed with pairs of aligned recessed slots 21 formed in communication with the upper edge of the base 16 to receive respective spaced first and second axles 22 and 28 of the respective retraction and dispensing rolls 24 and 25. The rolls 24 and 25 are in paralleled spaced alignment to each other, and wherein the rearward ends of the respective first and second axles 22 and 28 are provided with first and second driven gears 26 and 27. The parallel spaced alignment of the rolls 24 and 25 is significant to enable a single central drive gear 28 to operate simultaneously both driven gears 26 and 27. The central drive gear 28 is operative by means of a motor 81 provided with an outwardly extending motor axle 30. The motor axle 30 extends exteriorly of the base 16 and associated housing 15 and terminates with a manual over-ride wheel 29 whereupon a malfunction of the motor 31 enables manual turning of the serrated circumferential surface of the wheel 29 to enable actuation of the retraction and dispensing rolls 24 and 25 respectively.

The dispensing roll 25 is defined by a roll of tubular covering material 32 and is delivered to envelop the toilet seat 12 originating at the second end 14 through a dispensing slot 17*a* formed in a side wall of the lid 17. Similarly, a receiving slot (not shown) of parallel construction to the dispensing slot 17*a* receives the terminal end of the tubular covering 32 for securement about the retraction roll 24. To assist in securement initially of the forward terminal end of the tubular covering 32, a plurality of projecting tape ends 32*a* are formed at the forward terminal end of the tubular covering 32 for securement initially about the retraction roll 24 to secure that end to the associated roll. The tubular covering 32 is formed with a slit 33 positioned in alignment with the interior circumferential edge of the seat in alignment with a plurality of first and second "U" shaped brackets 34 and 35 formed with a first short leg extending orthogonally outwardly of the interior circumferential edge of the seat 12 with an intermediate base portion extending downwardly orthogonally relative to the first leg with a longer leg extending rearwardly underlying each respective surface adjacent the ends 13 and 14 of the seat 12 and are each respectively formed with a hinge defined by a second hinge 36 of the "U" shaped bracket 34, and a third hinge 37 formed at a rearward terminal end of the second "U" shaped bracket 35. It should be noted that the first hinge 18, the second hinge 36, and the third hinge 37 are each in alignment along a hinge access 38 to enable unencumbered pivotment of the seat 12 with respect to the commode 11. First and second "U" shaped brackets 34 and 35 are integrally secured together in association with the housing 15 by a link 40 integrally joining the first and second "U" shaped brackets together and integrally secured to the bottom surface of the base 16 to enable unitary pivotment of the housing 16 and the toilet seat 12. An actuator button 39 is positioned through-extending a top surface of the lid 17 to energize the associated motor 31 in a conventional manner to direct a desired amount of covering about the seat 12. The motor 31 may receive power through a conventional battery pack (not shown) or through the use of a direct current transformer, as is conventional in the application of power to direct current motors of this class.

The upward bias of the housing 15 in association with the toilet seat 12 by the spring 19, as noted earlier, spaces the toilet seat 12 above the top surface of the commode 11 and lifts the associated forward ribs 12*a*, mounted to the lid 12, slightly above the top surface of the commode 11 to eliminate friction and resistance that would normally be effected by the positioning of the ribs 12*a* upon the top surface of the commode 11.

As to the manner of usage and operation of the instant invention, the same should be apparent from the above description, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automated toilet seat cover apparatus in combination with an associated toilet seat and commode and a tubular covering, the apparatus mounted for applying the covering to the toilet seat, the toilet seat apparatus mounted to the commode wherein, the toilet seat is formed with a first end spaced from a second end and a fixed distance, and a single housing mounted to the toilet seat between said first and second ends, and a dispensing roll rotatably mounted in said housing for dispensing said tubular covering encasing said toilet seat through a dispensing slot in said housing in alignment with said second end, and a retraction roll rotatably mounted in said housing for retraction of said tubular covering through a retraction slot in alignment with said first end for retraction of said tubular covering about said retraction roll, and said tubular covering mounted in a slidable surrounding relationship to said toilet seat, and a selectively actuable motor means spaced between said dispensing and retraction rolls to simultaneously rotate each roll to simultaneously dispense unused tubular covering encasing said toilet seat and retract priorly positioned tubular covering encasing said toilet seat upon actuation of said motor means, and wherein said housing is formed with a base member and a lid member partially mounted to the base member and includes a latch to secure the lid to the base member, and wherein said base member contains said dispensing roll and said retraction roll in a spaced parallel relationship, and wherein said motor means is positioned between said dispensing roll and said retraction roll at a rearward end thereof, and wherein said retraction roll is formed with a first axle and said dispensing roll is formed with a second axle wherein each first and second axles are positioned within spaced aligned slots formed within said base member, and a rearward end of each axle is formed with a driven gear cooperating with a drive gear rotatably mounted to said motor means.

2. An automated toilet seat cover apparatus as set forth in claim 1 wherein said drive gear is rotatably mounted to said motor means by a drive axle orthogonally formed to said drive gear extending from said motor means through said drive gear and extending exteriorly of said housing and formed with a further manually manipulatable wheel at a terminal remote end of said drive axle for manual manipulation of said drive gear to selectively manually actuate said dispensing and retraction rolls, and wherein said motor means is provided with an actuation button for electrically actuating said motor means.

3. An automated toilet seat cover apparatus as set forth in claim 2 wherein said dispensing and retraction slots are formed through said lid member and are in substantial alignment with one another.

4. An automated toilet seat cover apparatus as set forth in claim 3 wherein first and second "U" shaped brackets extend exteriorly and orthogonally from an interior peripheral circumferential edge of the toilet seat and underlie the toilet seat and extend rearwardly thereof, and terminate in respective first and second hinge members in axial alignment with a first hinge member formed on a rearwardmost edge of the housing, and wherein the hinge members are secured to a rearward surface of the commode.

5. An automated toilet seat cover apparatus as set forth in claim 4 wherein said tubular covering is formed with a slit in alignment with the rear interior circumferential edge of the toilet seat.

6. An automated toilet seat cover apparatus as set forth in claim 5 wherein a spring member is secured to said housing to resiliently bias said housing upwardly of the commode and further including a link secured between said "U" shaped brackets to secure said "U" shaped brackets and said housing together to bias said toilet and said housing upwardly in reaction to said spring.

* * * * *